United States Patent [19]

Yamamoto

[11] Patent Number: 4,658,230

[45] Date of Patent: Apr. 14, 1987

[54] MAGNETICALLY OPERATED ACTUATOR

[76] Inventor: Seiji Yamamoto, 2-11-6-406, Tsurukawa, Machida-shi, Tokyo-to, Japan

[21] Appl. No.: 846,134

[22] Filed: Mar. 31, 1986

[30] Foreign Application Priority Data

Apr. 13, 1986 [JP] Japan ..... 60-79031

[51] Int. Cl.[4] ..... H01F 7/08

[52] U.S. Cl. ..... 335/230; 335/81

[58] Field of Search ..... 335/78, 79, 80, 81, 335/229, 230, 234

[56] References Cited

U.S. PATENT DOCUMENTS 4,560,966 12/1985 Nagamoto et al. ..... 335/81 X

*Primary Examiner*—George Harris

*Attorney, Agent, or Firm*—Omri M. Behr

[57] ABSTRACT

A magnetically operated actuator which comprises a generally elongated operating element displaceable between first and second positions, an electromagnet assembly for driving the operating element to displace between the first and second positions and comprising an iron core and a solenoid coil disposed around the iron core, a permanent magnet assembly rigidly mounted on the operating element and having a pair of opposite poles different in polarity from each other and having a magnetic field which is developed between the opposite poles, and a stopper member for restricting the stroke of movement of the operating element between the first and second positions. The electromagnet assembly is fixedly supported in position with one of the opposite ends of the iron core situated in the magnetic field developed between the poles of the permanent magnet assembly. The first and second positions are located in the vicinity of the opposite poles of the permanent magnet assembly.

7 Claims, 9 Drawing Figures

MAGNETICALLY OPERATED ACTUATOR

BACKGROUND OF THE INVENTION

The present invention generally relates to a magnetically operated actuator and, more particularly, to the magnetically operated actuator suited for actuating an operating element such as used in, for example, a photographic shutter mechanism, a photographic aperture mechanism, a high speed on-off electric switch or any other machine component which required to be operated in response to the application of an electric enabling signal.

A magnetically operated actuator utilizing a combination of electromagnet and permanent magnet is currently commercially available, wherein the magnetic forces produced respectively by the electromagnet and the permanent magnet interact with each other to drive an operating element for, for example actuating a switch contact used in a control circuit. The prior art magnetically operated actuator is generally so designed as to make use of the opposite polarities, induced in the electromagnet when the latter is electrically energized, in actuating the operating element, that is, as to establish a closed magnetic circuit between the electromagnet and the permanent magnet.

When it comes to the utilization of the opposite polarities induced in the electromagnet for the purpose of actuating the operating element, it has been found difficult to proportionate the magnetic force emanating between the opposite poles of the electromagnet with the magnetic force of the permanent magnet coupled with the operating element and, therefore, the drive produced by the magnetically operated actuator as a whole tends to become insecure.

Moreover, although it seems that the drive produced by the magnetically operated actuator will theoretically double when the opposite poles of the electromagnet is utilized as compared with the case when only one of the opposite poles thereof is utilized, the fact is that the drive produced by the magnetically operated actuator as a whole tends to be cut by half because the proportionated relationship between the magnetic forces produced respectively by the electromagnet and the permanent magnet fails to sustain itself with the result that the magnetic force of attraction produced by one of the electromagnet and the permanent magnet will not match with the magnetic force of repulsion produced by the other of the electromagnet and the permanent magnet.

In addition, in the prior art magnetically operated actuator now under discussion, since at least one of the opposite polarities produced in the electromagnet must be magnetically conducted to a position at which it is actually utilized, the use of a relatively bulky iron core in the electromagnet is necessitated and/or the magnetically operated actuator itself tends to become complicated in structure to such an extent as to result in the deviation in performance from one actuator to another during the manufacture thereof.

Furthermore, since during the operation of the magnetically operated actuator the operating element is brought into contact with any one of the opposite poles of the electromagnet, the operating element is susceptible to the built-up of residual magnetism which will constitute a cause of reduction in response of the operating element to the application of an electric signal.

SUMMARY OF THE INVENTION

The present invention has accordingly been developed with a view to substantially eliminating the above described disadvantages and inconveniences inherent in the prior art magnetically operated actuator and has for its essential object to provide an improved, high performance magnetically operated actuator wherein only one of the opposite poles of the electromagnet is used in cooperating relationship with the permanent magnet so that the respective magnetic forces emanating from the electromagnet and the permanent magnet can be readily and easily proportionated with each other during the fabrication thereof.

The present invention also has for its another important object to provide an improved, high performance magnetically operated actuator of the type referred to above, wherein no contact takes place between the operating element and any portion of the electromagnet with the service life consequently prolonged.

A further object of the present invention is to provide an improved, high performance magnetically operated actuator of the type referred to above, which is quick in response to the applied electric signal and reliable in performance.

A still further object of the present invention is to provide an improved, high performance magnetically operated actuator of the type referred to above, which can be advantageously manufactured easily and compact in size with no increase substantially incurred in cost.

In order to accomplish these object of the present invention, an improved, high performance magnetically operated actuator according to the present invention comprises an operating element selectively displaceable between first and second positions spaced apart from each other, an electromagnet assembly for driving the operating element to displace the latter between the first and second positions under the influence of magnetism emanating therefrom, and a permanent magnet assembly rigidly secured to the operating element. The permanent magnet assembly comprises at least one permanent magnet having poles opposite in polarity to each other and between which a magnetic field is established.

The electromagnet assembly includes a generally elongated iron core having a solenoid coil mounted therearound, and is fixedly supported in position with one of the opposite ends of said iron core confronting the magnetic field between the poles of the permanent magnet. Since the magnetic field is constantly developed between the poles of the permanent magnet, the flow of and electric power in one of the opposite directions through the solenoid coil results in the development of a magnetic force of attraction between said one end of the iron core and one of the poles of the permanent magnet and also a magnetic force of repulsion between said one end of the iron core and the other of the poles of the permanent magnet, whereas the flow of an electric current in the other of the opposite directions through the solenoid coil results in the development of a mangetic force of attraction between said one end of the iron core and said other of the poles of the permanent magnet and also a magnetic force of repulsion between said one end of the iron core and said one of the poles of the permanent magnet.

Thus depending upon the direction of flow of the electric current through the solenoid coil of the electromagnet assembly, the operating element can be displaced to one of the first and second positions. Depending on the application of the magnetically operated actuator of the present invention, the electric current to be applied to the solenoid coil may be an alternating current, in which case the operating element could be repeatedly displaced between the first and second positions in a number of cycles equal to the cycle of the alternating current.

In a preferred embodiment herein discloses, the permanent magnet assembly comprises two permanent magnets secured to the operating element-on respective sides thereof. Preferably, the permanent magnet assembly has pole-pieces formed integrally with, or otherwise rigidly connected to, the respective poles of the permanent magnet assembly so as to protrude in a direction close towards the iron core of the electromagnet assembly with a working space defined between said pole pieces, in which space the magnetic field is established.

Preferably, the pole pieces are made of magnetizeable plate members separate from the permanent magnet or magnets, which plate members are rigidly secured to the respective poles of the permanent magnet or magnets.

Also, preferably, a stopper means is provided for regulating the stroke of displacement of the operating element in such a way that, when the operating element is displaced to one of the first and second positions, a slight clearance can be formed between the one end of the iron core of the electromagnet assembly and the respective pole pieces of the permanent magnet assembly.

The permanent magnet assembly and the electromagnet assembly may be supported on either a common support structure or respective support structure coupled with each other. The stopper means referred to above is preferred to be formed in the support structure supporting the permanent magnet assembly in the case where the separate support structures are employed, or a portion of the common support structure adjacent the permanent magnet assembly.

The one end of the iron core of the electromagnet assembly may terminate either within the working space or outside the working space provided that the polarity established at said one end of the iron core when the solenoid coil is energized can coactwith the magnetic field developed between the poles or pole pieces of the permanent magnet assembly.

Thus, according to the present invention, the magnetism emanating from only one end of the iron core of the electromagnet assembly is utilized, that is, only the single-pole of the electromagnet is utilized, in cooperation with the magnetic field developed between the poles or pole pieces of the permanent magnet assembly.

Also, according to the present invention, the employment of the stopper means makes it possible to avoid any possible contact between the one end of the iron core of the electromagnet assembly and any one of the pole pieces of the permanent magnet assembly.

BRIEF DESCRIPTION OF THE DRAWINGS

These and other objects and features of the present invention will become readily understood from the following detailed description thereof taken in conjunction with preferred embodiments thereof with reference to the accompanying drawings, in which like parts are designated by like reference numerals and in which.

DETAILED DESCRIPTION OF THE PREFERRED EMBODIMENTS

Figure 1:
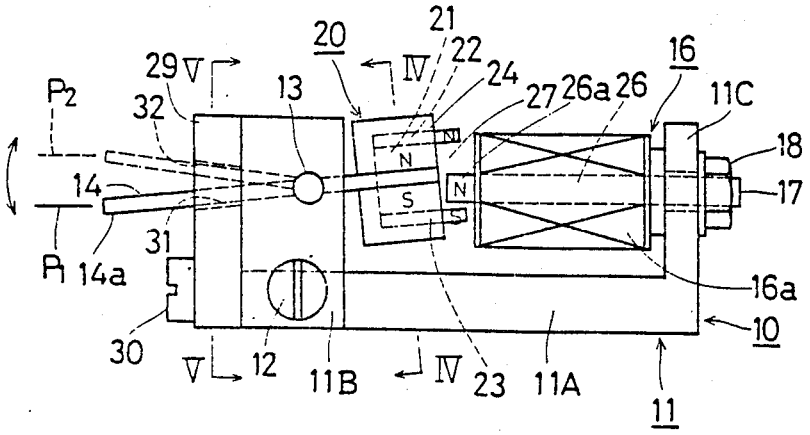
FIG. 1 is a schematic side view of a novel magnetically operated actuator according to a first preferred embodiment of the present invention.
Figure 2:
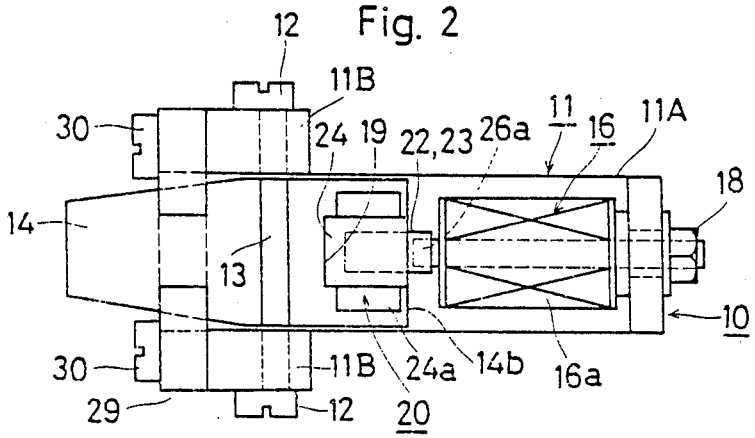
FIG. 2 is a top plan view of the novel magnetically operated actuator shown in FIG. 1.
Figure 3:
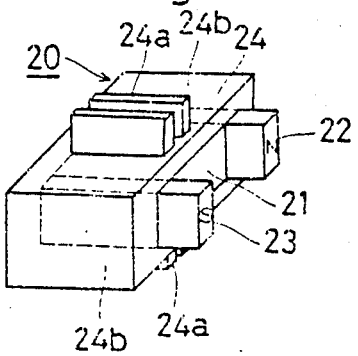
FIG. 3 is a perspective view, on a somewhat enlarged scale, showing a permanent magnet assembly used in the novel magnetically operated actuator shown in FIG. 1.

Referring first to FIGS. 1 to 3, a novel magnetically operated actuator shown therein comprises a support structure 10 including a generally L-shaped body 11 comprised of an elongated base 11A and an upright wall 11C integral with one end of the base 11A and extending perpendicular to the base 11A. The support structure 10 also includes a pair of generally rectangular side walls 11B secured by means of screws 12 to opposide side faces of the base 11A at the opposite end portion of said base 11A so as to confront with each other. A generally plate-like operating member 14 is pivotally supported by the side walls 11B by means of a shaft or pin member 13 journalled at its opposite ends to the respective side walls 11B. The mounting of the operating member 14 on the shaft 13 may be carried out in any suitable manner, but in the illustrated embodiment the shaft 13 has its substantially intermediate portion slotted axially for the passage of the operating member 14 therethrough and the operating member 14 so passed through the slot in the shaft 13 is fixed in position.

The magnetically operated actuator also comprises an electromagnet assembly 16 supported by the upright wall 11C of the support structure 11 so as to face towards the operating member 14 with its longitudinal sense lying generally parallel to the longitudinal axis of the base 11A as will be described in detail later, and a permanent magnet assembly 20 rigidly mounted on one one the opposite ends of the operating member 14 adjacent the electromagnet assembly 16. For supporting the permanent magnet assembly 20 of the construction which will be described later with particular reference to FIGS. 3 and 4, the operating member 14 has a generally U-shaped cutout or socket 19 formed by recessing inwardly thereof from that end of the operating member 14 adjacent the electromagnet assembly 16 in alignment with the longitudinal axis of the operating member 14.

Figure 4:
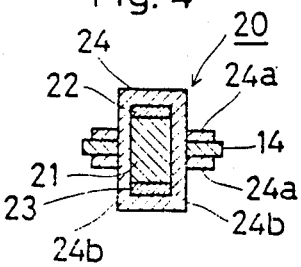
FIG. 4 is a cross-sectional view taken along the line IV—IV in FIG. 1.

The permanent magnet assembly 20 comprises, as best shown in FIGS. 3 and 4, a generally rectangular permanent magnet 21 having N and S poles at its opposite ends and also having a pair of generally elongated magnetizeable pole pieces 22 and 23 connected to the N and S poles of the permanent magnet 21, respectively. The assembly of the permanent magnet 21 and the pole pieces 22 and 23 is inserted into a casing 24 in such a manner that one end of each of the pole pieces 22 and 23 canprotrude a predetermined distance laterally outwardly from the permanent magnet 21 and also the casing 24, thereby representing a generally U-shaped contour. The casing 24 is made of non-magnetizeable material such as, for example, hard synthetic resin, aluminum, copper or phosphoric bronze, and the use of synthetic resin or aluminum is preferred as a material for the casing 24 where the operating member 14 is desired to be as light in weight as possible to permit it to be displaced at high speed. It is, however, to be noted that, where the operating member 14 is made of non-magnetizeable material, the use of the casing may not be always essential because no closed magnetic circuit will not be formed between the permanent magnet assembly 20 and the operating member 14.

Referring still to FIGS. 3 and 4, each of the opposite side walls **24*b* forming the casing 24 has a pair of spaced flange members 24*a* protruding laterally outwardly therefrom and spaced from each other a distance equal to or slightly greater than the thickness of the operating member 14, the paired flange member 24*a* on one of the opposite side walls 24*b* being aligned in position with the paired flange members 24*a* on the other of the opposite side walls 24*b***.

The permanent magnet assembly 20 of the construction described with reference to and shown in FIGS. 3 and 4 is received in the socket 19 in the operating member 14 with the paired flange members **24*a* of the casing 24 clamping the thickness of the operating member 14 as best shown in FIG. 4. Any suitable bonding agent may be employed to form a bond connection between the paired flange members 24*a* and the operating member 14 for securing the rigid connection between the permanent magnet assembly 20 and the operating member 14. Thus, with the permanent magnet assembly 20 so mounted on the operating member 14, the pole pieces 22 and 23 fast with the N and S poles of the permanent magnet 21 lie in parallel relation to the operating member 14 as best shown in FIG. 1 and that respective ends of the pole pieces 22 and 23 which protrude laterally outwardly from the permanent magnet 21 confront the electromagnet assembly 16 while forming a working space 27** therebetween.

It is to be noted that, where the operating member 14 is made of magnetizeable material such as, for example iron, the casing 24 is preferred to be thickwalled so that each of the pole pieces 22 and 23 can be spaced an increased distance from the operating member 14 thereby to avoid any possible shortcircuiting between a magnetic circuit including the permanent magnet 21 and one of the pole pieces 22 and 23 and a magnetic circuit including the permanent magnet 21 and the other of the pole pieces 22 and 23.

Referring back to FIGS. 1 and 2, the electromagnet assembly 16 includes an elongated iron core 26 around which the solenoid coil **16*a* is formed. This iron core has one end threaded to provide a threaded end 17, and the electromagnet assembly 16 is supported by the upright wall 11C of the support structure 10 with the threaded end 17 of the iron core 26 threaded through the upright wall 11C. A portion of the threaded end 17 on one side of the upright wall 11C remote from the permanent magnet assembly 20 has a lock nut 18 threadingly mounted thereon for securing the electromagnet assembly 16 in position relative to the support structure 10**.

If desired, the hole defined in the upright wall 11C and through which the threaded end 17 extends may either have a diameter slightly greater than the maximum outer diameter of the threaded end 17 or be in the form of a cross-shaped opening, so that the position of the electromagnet assembly 16 relative to the permanent magnet assembly 20 can be adjusted to a desired preciseness.

With the electromagnet assembly 16 so supported in the manner as hereinbefore described, a free end **26*a* of the iron core 26 remote from the upright wall 11C protrudes into the working space 27, terminating spaced a distance inwardly from the permanent magnet 21 mounted on the operating member 14 through the casing 24. Thus, it will readily be seen that, when an electric current is supplied to the electromagnet assembly 16 so as to flow through the solenoid coil 16 in one of the opposite directions, the free end 26*a* of the iron core 26 will become either a N pole or a S pole depending upon the direction of flow of the electric current through the solenoid coil 16. Assuming that the free end 26*a* of the iron core 26 becomes the N pole as shown in FIG. 1, a magnetic force of attraction is developed between the pole piece 23 and the free end 26*a* of the iron core, causing the operating member 14 to pivot counterclockwise, as viewed in FIG. 1, about the shaft 13 to assume a first position indicated by P1, but when the free end 26*a* becomes the S pole while the operating member 14 is in the first position P1, a magnetic force of repulsion is developed between the pole piece 23 and the free end 26*a* on the one hand and a magnetic force of attraction is developed between the pole piece 22 and the free end 26*a* causing the operating member 14 to pivot clockwise about the shaft 13 to assume a second position P2** as shown by the phantom line.

Figure 5:
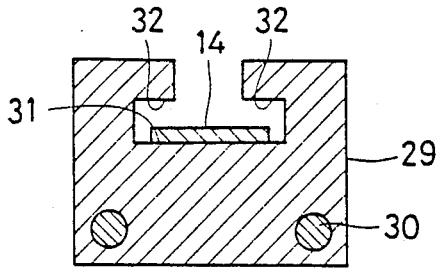
FIG. 5 is a cross-sectional view taken along the line V—V in FIG. 1.

In the illustrated embodiment wherein the free end **26*a* of the iron core 26 protrudes into the working space 27 inwardly of a plane lying in touch with respective free end faces of the pole pieces 22 and 23 adjacent the electromagnet assembly 16, the free end 26*a* of the iron core 26 abuts against the pole pieces 22 and 23 when the operating member 14 is pivoted to the second and first positions P2 and P1, respectively. In order to avoid such direct contact of the free end 26*a* of the iron core 26 with any one of the pole pieces 22 and 23, a stopper defining plate 29 is secured by means of one or more set screws or bolts 30 to a free end of the base 11A of the support structure 10 in face-to-face relationship with the upright wall 11C. As best shown in FIG. 5, the stopper defining plate 29 has a generally inverted T-shaped opening defined therein so as to leave a pair of spaced stopper faces 31 and 32 which are positioned one above the other in a direction conforming to the direction of pivot of the operating member 14. As shown in FIG. 5, the stopper defining plate 29 is secured to the base 11A of the support structure 10 with the operating member 14 loosely extending through a horizontal portion of the inverted-T-shaped opening in the stopper defining plate 29, the space between the stopper faces 31 and 32 being so selected and so sized as to permit a slight clearance to be formed between the free end 26*a* of the iron core 26 and each of the pole pieces 22 and 23 when the operating member 14 is pivoted to the second or first position P2 or P1** in the manner as hereihbefore described.

The formation of the slight clearances uniformly between the free end 26a of the iron core 26 and the pole piece 22 and between the free end 26a and the pole piece 23, respectively, can be readily accomplished by positioning the operating member 14 at a position intermediate between the first and second positions P1 and P2, determing the position of the electromagnet assembly 16 relative to the upright wall 11C with the free end 26a positioned intermediately between the pole pieces 22 and 23, and finally fastening the lock nut 18 to lock the electromagnet assembly 16 in position.

It is to be noted that in the embodiment described with reference to and shown in FIGS. 1 to 5, the operating member 14 is pivotable in a plane orthogonal to the longitudinal axis of the operating member 14.

The free end of the operating member 14, shown by 14a may be operatively coupled with any suitable machine component to be operated by the magnetically operated actuator of the present invention, such as, for example, a movable contact member of an electric switch or a shutter release member of a photographic camera. Depending upon the application, a plurality of magnetically operated actuators each being of the construction described above and shown in FIGS. 1 to 5 may be mounted on a single support structure with the respective solenoid coils electrically connected to a programmable control unit, for example, a computer, so that machine components to be controlled according to a predetermined program can be actuated in any desired or required sequence by the operating members of the respective magnetically operated actuators.

While the magnetically operated actuator according to the present invention is constructed as hereinbefore described, that ends of the pole pieces 22 and 23 which protrude laterally outwardly from the permanent magnet 21 are polarized to N and S poles, respectively, because the pole pieces 22 and 23 are coupled with the N and S poles of the permanent magnet 21, respectively. Therefore, as hereinbefore described, depending upon the direction of flow of the direct current through the solenoid coil 16a of the electromagnet assembly 16, the magnetic force of attraction is developed between one of the pole pieces 22 and 23 and the free end 26a of the iron core 26 and, at the same time, the magnetic force of repulsion is developed between the other of the pole pieces 22 and 23 and the free end 26a of the iron core 26. The duration during which the direct current is supplied to the solenoid coil 16a depends on the particular application of the magnetically operated actuator of the present invention and may range from a few milliseconds to hours. It is to be noted that the supply of the direct current to the solenoid coil 16a may be interrupted after the operating member 14 has been pivoted to any one of the first and second positions P1 and P2 and as long as the operating member 14 is desired to be retained in such one of the first and second positions P1 and P2. This is possible because, once the operating member 14 has been pivoted to one of the first and second positions P1 and P2 and the supply of the direct current to the solenoid coil 16a has subsequently been interrupted, a corresponding one of the pole pieces 22 and 23 permanently polarized to the particular polarity in contact with the permanent magnet 21 remains magnetically attracting the free end 26a of the iron core 26.

From the foregoing description, it has now become clear that, in the magnetically operated actuator according to the present invention, only one of the opposite polarities of the electromagnet assembly is used in cooperation with the permanent magnet assembly, that is, only the polarity developed at the free end of the iron core of the electromagnet assembly is utilized. Therefore, as compared with the prior art wherein the opposite polarities of the electromagnet assembly are utilized, the problem associated with the difficulty in proportionating the magnetic forces can be substantially eliminated, making it possible to manufacture the magnetically operated actuator easily and compact in size and also rendering the operation of the magnetically operated actuator to be reliable.

The use of the elongated iron core renders the electromagnet assembly to be simple in construction and to be easy to manufacture.

Moreover, the use of the stopper defining plate restricting the stroke of pivotal movement of the operating member avoids the direct contact of the free end of the iron core with any one of the pole pieces which would otherwise result in damage to the pole pieces as well as the iron core, and accordingly, the magnetically operated actuator according to the present invention could be used for a substantially prolonged period of time. In addition, the set-up of the residue magnetism does not occur substantially in the free end of the iron core because of the avoidance of the direct contact between the free end of the iron core and any one of the pole pieces as hereinabove described and, therefore, the response of the magnetically operated actuator to the applied electric signal could be increased.

In the foregoing embodiment described with reference to and shown in FIGS. 1 to 5, the operating member 14 has been described and shown as pivotable in a plane orthogonal to the longitudinal axis of the operating member 14. However, in accordance with the teachings of the present invention, it is possible to render the operating member 14 to pivot in a plane parallel to the longitudinal axis of the operating member 14 and also to displace in a direction longitudinally of the operating member 14. The example in which the operating member 14 pivots in a plane parallel to the longitudinal axis threof is shown in FIGS. 6 and 7, reference to which will now be made.

Figure 6:
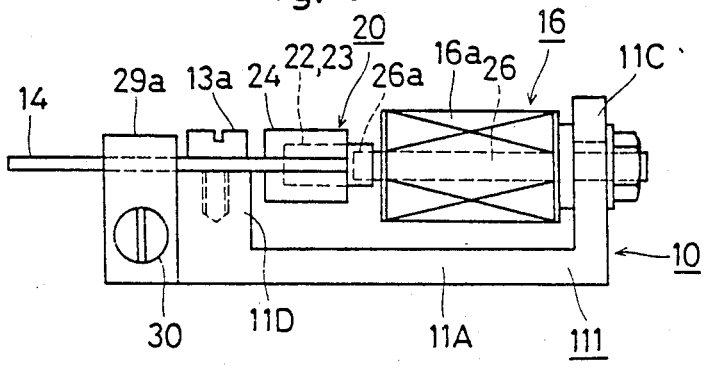
FIG. 6 is a schematic side view of the novel magnetically operated actuator according to a second preferred embodiment of the present invention.
Figure 7:
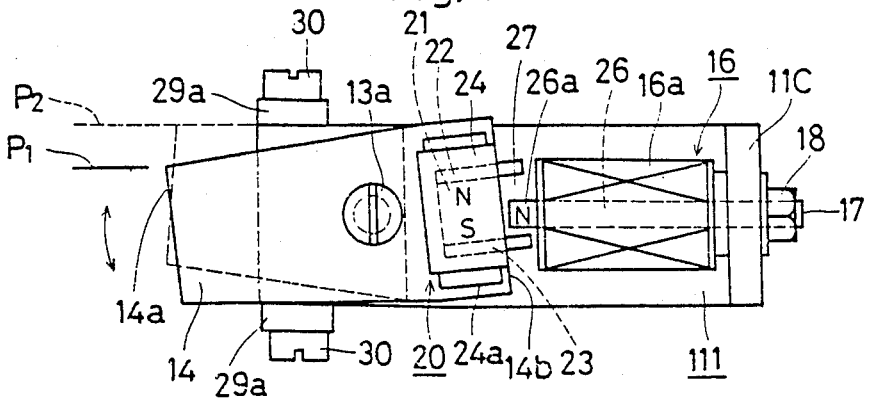
FIG. 7 is a top plan view of the novel magnetically operated actuator shown in FIG. 6.

In the embodiment shown in FIGS. 6 and 7, the support structure 10 employs a generally U-shaped body 111 unlike the generally L-shaped body 11 employed in the foregoing embodiment. The U-shaped body 111 has, in addition to the base 11A and the upright wall 11C, a bench 11D integrally formed with the base 11A at one end thereof remote from the upright wall 11C so as to extend perpendicular to the base 11A. The height of the bench 11D above the base 11A is lower than that of the upright wall 11C and is so selected as to permit the bench 11D to have a top surface generally in flush with the iron core 26.

The operating member 14 is pivotally mounted on the top surface of the bench 11D by means of a pin or screw 13a so that the operating member 14 can pivot in a plane parallel to the top-surface of the bench 11D between the first and second positions P1 and P2.

For restricting the stroke of pivotal movement of the operating member 14 between the first and second positions P1 and P2, stopper pieces 29a are secured by the set screws 30 to opposite lateral surfaces of the bench 11D from lateral direction, the space between the stopper pieces 29a being so selected as to permit the slight clearance to be formed between any one of the pole pieces 22 and 23 and the free end 26a of the iron core 26 when the operating member 14 is pivoted to the second or first position P2 or P1. Alternatively, instead of the employment of the stopper pieces 29a, the top surface of the bench 11D may be recessed inwardly for accommodating therein the operating member 14, the recess being so sized that the width thereof as measured across the operating member 14 can correspond to the span between the stopper pieces 29a referred to above. In addition, instead of the employment of the separate stopper pieces 29a, the stopper defining plate 29 used in the foregoing embodiment could be used in this embodiment.

Figure 8:
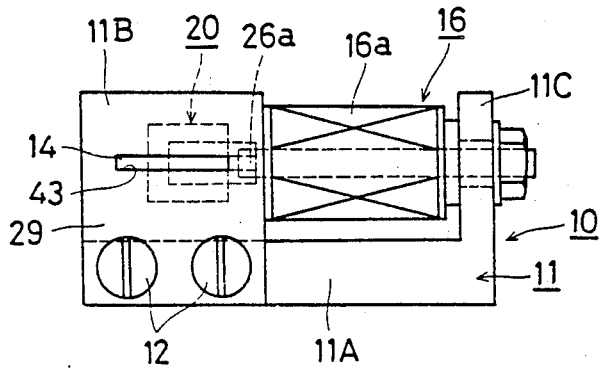
FIG. 8 is a schematic side view of the novel magnetically operated actuator according to a third preferred embodiment of the present invention.
Figure 9:
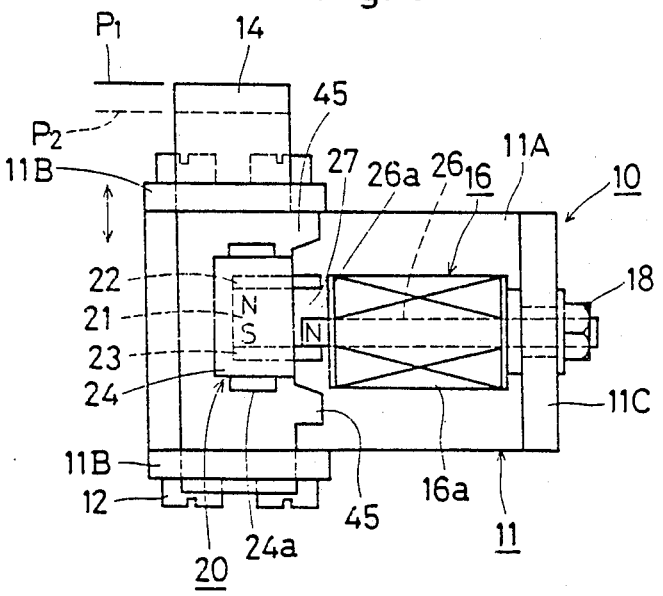
FIG. 9 is a top plan view of the novel magnetically operated actuator shown in FIG. 8.

The other example in which the operating member 14 moves between the first and second positions P1 and P2 in a direction longitudinally thereof is shown in FIGS. 8 and 9.

As best shown in FIG. 8, each of the side walls 11B positioned on respective sides of the base 11A and secured thereto by means of the set screws or bolts 12 has a slot 43 defined therein with its longitudinal axis lying in parallel relation to the longitudinal axis of the iron core 26. The operating element 14 which in the embodiment shown in FIGS. 8 and 9 is of a generally rectangular configuration is axially slidably accommodated in the slots 43 in the respective side walls 11B for movement between the first and second positions P1 and P2 in a direction perpendicular to the longitudinal axis of the iron core 26.

On one side of the operating member 14 facing towards the electromagnet assembly 16, the operating member 14 is formed with a cutout or socket similar to the socket 19 shown in FIG. 2 for the support of the permanent magnet assembly 20 in a manner similar to that described in connection with the first preferred embodiment. Although the permanent magnet assembly 20 in the embodiment shown in FIGS. 8 and 9 is mounted on that side of the operating member 14, the assembly 20 confronts the electromagnet assembly 16 in the subtantially same way as that in the first preferred embodiment, that is, with the pole pieces 22 and 23 facing the solenoid coil 16a while the free end 26a of the iron core 26 protruding into the working space 27 as best shown in FIG. 9.

The operating member 14 in the embodiment shown in FIGS. 8 and 9 is formed with a pair of spaced projections 45 on respective sides of the permanent magnet assembly 20 and protruding from the side edge of the operating member 14 in a direction close towards the upright wall 11C and situated between the side walls 11B. These projections 45 are adapted to abut against the adjacent side walls 11B one when the operating member 14 is laterally displaced to the first and second positions P1 and P2, and accordingly, it will readily be seen that portions of the side walls 11B adjacent the respective slots 43 and to which the associated projections 45 abut constitute stoppers for restricting the stroke of movement of the operating member 14 between the first and second positions P1 and P2.

Thus, except for difference in direction of movement or displacement of the operating member 14, the magnetically operated actuator according to any one of the second and third preferred embodiments of the present invention functions in a manner similar to that according to the first preferred embodiment of the present invention and, therefore, the details thereof will not be reiterated for the sake of brevity. In addition, the magnetically operated actuator according to any one of the second and third preferred embodiments of the present invention can exhibit advantages similar to that exhibited by the actuator according to the first preferred embodiment.

The present invention having been fully described has the following additional advantages. More specifically, physical friction between movable parts takes place at a minimized number of locations, that is, only at a location where the shaft 13 or the pin 13a extends through the operating member 14 in the first and second preferred embodiments and only at two locations where the operating member 14 extends movably through the slots 34 in the side walls 11B in the third preferred embodiment. Therefore, the movement of the operating member 14 receives a minimized resistance resulting from the friction, rendering the magnetically operated actuator as a whole to be reliable in operation even during high speed drive of the operating member 14.

Also, since the permanent magnet 21 and the pole pieces 22 and 23 are firmly supported together in the casing 24, there is no substantial possibility that one or all of the magnets 21 and the pole pieces 22 and 23 may separate out from the casing 24 and/or the operating member 14 even though the latter is driven repeatedly at high speed.

Furthermore, since the permanent magnet assembly 20 is comprised of the permanent magnet 21 and the magnetizeable pole pieces 22 and 23, which may be metal plates and which are secured to the respective opposite poles of the permanent magnet 21, the permanent magnet 21 as well as each of the pole pieces 22 and 23 may be employed in the form of a generally rectangular cubical body, rendering the permanent magnet assembly 20 as a whole to be readily and easily assembled. This advantage is paramount, considering that the permanent magnet cannot be fabricated in a complicated shape.

Although the present invention has been fully described in connection with the preferred embodiments thereof with reference to the accompanying drawings, it is to be noted that various changes and modifications can readily be conceived by those skilled in the art. By way of example, the magnetically operated actuator according to the present invention can find many applications. As is well known to those skilled in the art, in a textile knitting machine, a plurality of jacks for driving knitting needles are mounted on a cylinder so that pads of the jacks can be axially driven thrtough associated grooves defined in the cylinder. When the pads of some of the jacks are axially upwardly pushed or radially inwardly pushed, the knitting needles associated therewith can be projected through the jacks to effect a knitting in a predetermined pattern. In such knitting machine, the magnetically operated actuator of the present invention can be used to operate the pads through the operating member according to a program stored in a computer.

Moreover, no stopper means may be employed if the free end of the iron core adjacent the permanent magnet assembly is so positioned as to protrude into the magnetic field emanating between the pole pieces and so as to terminate on one side of the plane, which lies in touch with the respective free ends of the pole pieces, remote from the permanent magnet.

Each of the pole pieces may be made of any suitable magnetizeable material, for example, a soft iron.

Furthermore, the mounting of the permanent per se, on the operating member may be carried out in any suitable manner, for example, by the use of a bonding agent or cement where the application of the magnetically operated actuator of the present invention permits.

Accordingly, such changes and modifications are to be construed as included within the true scope and spirit of the present invention unless they depart from the scope of the present invention as defined by the appended claims.

What is claimed is:

1. A magnetically operated actuator which comprises, in combination:

a generally elongated operating element supported for selective displacement between first and second positions;

an electromagnet assembly for driving the operating element to displace the latter between the first and second positions under the influence of magnetism emanating therefrom, said electromagnet assembly comprising an iron core and a solenoid coil disposed around the iron core;

a permanent magnet assembly rigidly mounted on the operating element and having a pair of opposite poles different in polarity from each other, said permanent magnet assembly having a magnetic field developed between the opposite poles, said electromagnet assembly being fixedly supported in position with one of the opposite ends of the iron core situated in the magnetic field developed between the poles of the permanent magnet assembly; and means for restricting the stroke of movement of the operating element between the first and second positions, said first and second positions being defined in the vicinity of the opposite poles of the permanent magnet assembly.

2. The actuator as claimed in claim 1, wherein the permanent magnet assembly comprises a permanent magnet and a pair of magnetizeable pole pieces secured to the opposite poles of the permanent magnet, said pole pieces having respective ends protruding laterally from the permanent magnet and defining a working space therebetween, said magnetic field being developed between said ends of the pole pieces.

3. The actuator as claimed in claim 1, wherein the permanent magnet assembly comprises a casing, a permanent magnet and a pair of magnetizeable pole pieces secured to the opposite poles of the permanent magnet, said permanent magnet and the magnetizeable pole pieces being accommodated firmly within the casing with respective ends of the pole pieces protruding outwardly from the casing, said casing being figidly mounted on the operating element with the ends of the pole pieces defining a working space therebetween in which the magnetic field is developed.

4. The actuator as claimed in claim 3, wherein the operating element has a recessed socket defined therein at a portion confronting the electromagnet assembly, and wherein the casing has a pair of opposite side wall members each having a pair of spaced flange members protruding outwardly therefrom, said permanent magnet assembly being fixedly received in the socket with the paired flange members sandwiching the operating element on respective sides of the permanent magnet assembly.

5. The actuator as claimed in claim 1, wherein the operating element comprises an elongated plate member pivotally supported at its substantially intermediate portion, the axis of pivot of said plate member lying in a plane parallel to the plate member and perpendicular to the longitudinal axis of said plate member, and wherein said restricting means comprises a stopper having a pair of engagements spaced from each other a distance corresponding to the distance between the first and second positions.

6. The actuator as claimed in claim 1, wherein the operating element comprises an elongated plate member pivotally supported at its substantially intermediate portion, the axis of pivot of said plate member lying in a plane perpendicular to the plate member, and wherein said restricting means comprises a pair of stopper pieces fixediy supported in position and spaced from each other a distance corresponding to the distance between the first and second positions.

7. The actuator as claimed in claim 1, wherein the operating element comprises an elongated plate member slidably supported for movement between the first and second positions in a direction parallel to the longitudinal axis of the plate member through a pair of spaced wall members each having a slot defined therein for the passage of the plate member therethrough, and wherein said restricting means comprises a pair of projection integrally formed with the plate member and positioned on respective sides of the permanent magnet assembly and inwardly between the wall members, said projections being spaced from each other a distance corresponding to the distance between the first and second positions and smaller the distance between the side walls.

* * * * *